US009905964B2

(12) United States Patent
Degner et al.

(10) Patent No.: US 9,905,964 B2
(45) Date of Patent: Feb. 27, 2018

(54) MAGNETICALLY ALIGNED ACCESSORY TO DEVICE CONNECTIONS

(71) Applicant: Apple Inc., Cupertino, CA (US)

(72) Inventors: Brett W. Degner, Menlo Park, CA (US); David H. Narajowski, Los Gatos, CA (US); Oliver C. Ross, San Francisco, CA (US); Hao Zhu, San Jose, CA (US); Erik A. Uttermann, Cupertino, CA (US); Stephen R. McClure, Belmont, CA (US); Melody L. Kuna, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/256,156

(22) Filed: Sep. 2, 2016

(65) Prior Publication Data

US 2017/0070001 A1 Mar. 9, 2017

Related U.S. Application Data

(60) Provisional application No. 62/214,160, filed on Sep. 3, 2015.

(51) Int. Cl.
*H01R 13/62* (2006.01)
*H01R 13/631* (2006.01)

(52) U.S. Cl.
CPC ..... *H01R 13/6205* (2013.01); *H01R 13/6315* (2013.01)

(58) Field of Classification Search
CPC ..... H01R 13/6205; H01R 13/6315
See application file for complete search history.

(56) References Cited

U.S. PATENT DOCUMENTS 7,541,907 B2 6/2009 Wang
8,143,983 B1 * 3/2012 Lauder ..... G06F 1/1626 24/303
8,599,542 B1 * 12/2013 Healey ..... G06F 1/1626 345/168
8,665,045 B2 3/2014 Lauder
8,953,310 B2 * 2/2015 Smith ..... G06F 1/16 160/266
9,072,352 B2 7/2015 Sartee et al.
(Continued)

FOREIGN PATENT DOCUMENTS

CN 102147643 A 8/2011
CN 102156510 A 8/2011
(Continued)

OTHER PUBLICATIONS

International Search Report dated Dec. 20, 2016 from corresponding International Application No. PCT/US2016/049847.
(Continued)

*Primary Examiner* — Harshad C Patel
(74) *Attorney, Agent, or Firm* — Downey Brand LLP

(57) ABSTRACT

An accessory to device coupling system can include a first magnet array adapted for assembly with respect to a surface of an electronic device and a second magnet array adapted for assembly with respect to a surface of an accessory device, the accessory device configured to interact electrically with the electronic device. The first magnet array can include a first plurality of magnets arranged in a first pattern of alternating polarities, and the second magnet array can include a second plurality of magnets arranged in a second pattern of alternating polarities that corresponds to the first pattern of alternating polarities. The corresponding alternating polarity patterns can cause the second magnet array to couple to the first magnet array with a normalized attraction force only at an intended orientation and alignment, and with less than half of the normalized attraction force at any other orientation and alignment.

20 Claims, 14 Drawing Sheets

(56) References Cited

U.S. PATENT DOCUMENTS

| | | | | |
|---|---|---|---|---|
| 9,130,291 | B2 * | 9/2015 | Poh | H01R 11/30 |
| 9,253,518 | B2 * | 2/2016 | Fay | H04N 21/6175 |
| 9,494,980 | B2 | 11/2016 | Corbin et al. | |
| 2007/0133156 | A1 * | 6/2007 | Ligtenberg | G06F 1/1616 361/679.27 |
| 2007/0138806 | A1 * | 6/2007 | Ligtenberg | E05C 19/16 292/251.5 |
| 2009/0269943 | A1 * | 10/2009 | Palli | H01R 13/6205 439/39 |
| 2013/0170126 | A1 | 7/2013 | Lee | |
| 2013/0176091 | A1 * | 7/2013 | Lancaster-Larocque | G06F 1/1616 335/306 |
| 2014/0065846 | A1 * | 3/2014 | Poh | H01R 11/30 439/39 |
| 2014/0368731 | A1 | 12/2014 | Hyers | |
| 2014/0375186 | A1 | 12/2014 | Tarnow | |
| 2015/0049426 | A1 | 2/2015 | Smith | |

FOREIGN PATENT DOCUMENTS

| | | | |
|---|---|---|---|
| CN | 102622052 | A | 8/2012 |
| CN | 103699182 | A | 4/2014 |
| WO | 2015077028 | A1 | 5/2015 |
| WO | 2015127376 | A1 | 8/2015 |

OTHER PUBLICATIONS

Chinese Patent for Utility Model No. ZL201621164352.1—Evaluation Report dated Jul. 11, 2017.

* cited by examiner

MAGNETICALLY ALIGNED ACCESSORY TO DEVICE CONNECTIONS

CROSS-REFERENCE TO RELATED APPLICATION

This application claims the benefit of U.S. Provisional Patent Application No. 62/214,160, filed on Sep. 3, 2015, which is incorporated by reference herein in its entirety for all purposes.

FIELD

The described embodiments relate generally to consumer electronic devices. More particularly, the described embodiments relate to accessory devices that are used in conjunction with consumer electronic devices.

BACKGROUND

Accessory devices that are used in conjunction with consumer electronic devices are known. Various electronic devices can include visual displays having touch screens that include sensors designed to receive touches, gestures, and other inputs in response to touches to the display. Such electronic devices can have associated accessory devices that provide additional functions therewith, such as smart covers and the like. If desired, alignments and/or electrical connectivity between such accessory devices and electronic device can be facilitated through the use of magnets in some cases. Unfortunately, magnets can be limited in nature, such as where magnetic attractions are still strong even where component alignments are offset or inaccurate. As such, the use of mechanical alignment features typically accompany magnetic components for aligning and coupling accessory devices to electronic devices. While magnetic based accessory device to electronic device connections and couplings have thus worked well in the past, there can be room for improvement. Accordingly, there is a need for improved magnetic based accessory device to electronic device couplings and connections.

SUMMARY

Representative embodiments set forth herein disclose various structures, methods, and features thereof for the disclosed magnetically aligned accessory to device couplings and connections. In particular, the disclosed embodiments set forth accessory device to electronic device couplings and connections that are facilitated by magnetic arrays or arrangements.

According to various embodiments, a magnetically aligned accessory to device connection facilitates coupling an accessory to an electronic device. The magnetically aligned accessory to device connection can include at least: 1) a first magnet array arranged in a first pattern of alternating polarities, and 2) a second magnet array arranged in a second pattern of alternating polarities that corresponds to the first pattern to facilitate a magnetic coupling. Each pattern can have an inner portion of alternating polarities that is symmetric about an inner point and an outer portion of alternating pluralities that is asymmetric about the inner or center point.

In some embodiments, each pattern can be linear, and magnets can be of varying lengths. The magnetic coupling can have a normalized attraction force only at one intended orientation and alignment of one magnet array to the other, and less than one-third of the normalized attraction force at any other orientation and alignment. Magnet array(s) can include shunts to limit magnetic flux elsewhere about the electronic device. Also, pins disposed at one magnet array can align with and contact electrical contacts at the other magnet array to provide for device connectivity when the magnet arrays couple at the intended orientation and alignment.

This Summary is provided merely for purposes of summarizing some example embodiments so as to provide a basic understanding of some aspects of the subject matter described herein. Accordingly, it will be appreciated that the above-described features are merely examples and should not be construed to narrow the scope or spirit of the subject matter described herein in any way. Other features, aspects, and advantages of the subject matter described will become apparent from the following Detailed Description, Figures, and Claims.

Other aspects and advantages of the embodiments described herein will become apparent from the following detailed description taken in conjunction with the accompanying drawings which illustrate, by way of example, the principles of the described embodiments.

BRIEF DESCRIPTION OF THE DRAWINGS

The included drawings are for illustrative purposes and serve only to provide examples of possible structures and methods for the disclosed magnetically aligned accessory to device connections. These drawings in no way limit any changes in form and detail that may be made to the embodiments by one skilled in the art without departing from the spirit and scope of the embodiments. The embodiments will be readily understood by the following detailed description in conjunction with the accompanying drawings, wherein like reference numerals designate like structural elements.

DETAILED DESCRIPTION

Figure 1A:
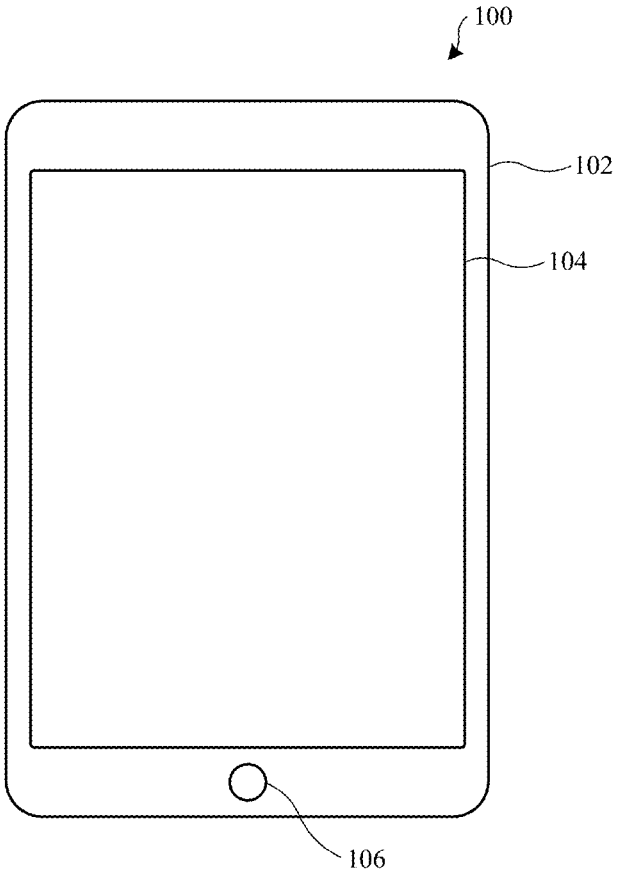
FIG. 1A illustrates in top plan view an exemplary electronic device according to various embodiments of the present disclosure.

Accessory devices that are used in conjunction with consumer electronic devices can provide additional functions therewith, such as by way of smart covers and the like. Couplings, alignments, and/or electrical connectivity between such accessory devices and other electronic devices can be facilitated through the use of magnets in some instances. Other mechanical alignment features are typically used as well, however, due to the generally inexact abilities of magnetic components to align different devices accurately as they are coupled. This can result in added parts, expenses, and complexities. It may thus be useful to provide improved components and ways for magnetically coupling accessories to consumer electronic devices.

The embodiments set forth herein provide various improved structures and methods for providing magnetically aligned accessory to device connections. A magnetically aligned accessory to device connection can include at least a first magnet array arranged in a first pattern of alternating polarities, and a second magnet array arranged in a second pattern of alternating polarities corresponding to the first pattern. Each magnet array can have a plurality of magnets arranged into the alternating polarity patterns, and the patterns can be matching inverses of each other, so as to facilitate a magnetic attachment and coupling through magnetic strength only. Each pattern can have an inner portion of alternating polarities that is symmetric about an inner point and an outer portion of alternating pluralities that is asymmetric about the inner point, which can be a center point. Each device or component to be coupled can have its own magnet array, such as a first magnet array for an electronic device and a second magnet array for an associated accessory device. In various embodiments, little to no added mechanical components or features are used to facilitate alignment and coupling of an accessory device to a primary or other electronic device. The magnetic coupling can have a normalized attraction force only at one intended orientation and alignment of one magnet array to the other, and less than one-half of the normalized attraction force at any other orientation and alignment.

In some embodiments, each magnet array pattern can be linear in nature and asymmetric about a central point, and the magnets can be of varying lengths. One or both magnet arrays can include shunts disposed between adjacent magnets to limit magnetic flux elsewhere about the electronic device. Further components can include a plurality of electrical contacts disposed at one magnet array, and a plurality of pins disposed at the other magnet array, wherein the pins align with and contact the electrical contacts when the magnet array couples to the first magnet array at the intended orientation and alignment. The pins and electrical contacts can be used to provide electrical connectivity between the devices.

The foregoing approaches provide various structures and methods for the disclosed magnetically aligned accessory to device connections. A more detailed discussion of these structures, methods, and features thereof is set forth below and described in conjunction with FIGS. 1-10, which illustrate detailed diagrams of devices and components that can be used to implement these structures, methods, and features.

Figure 1B:
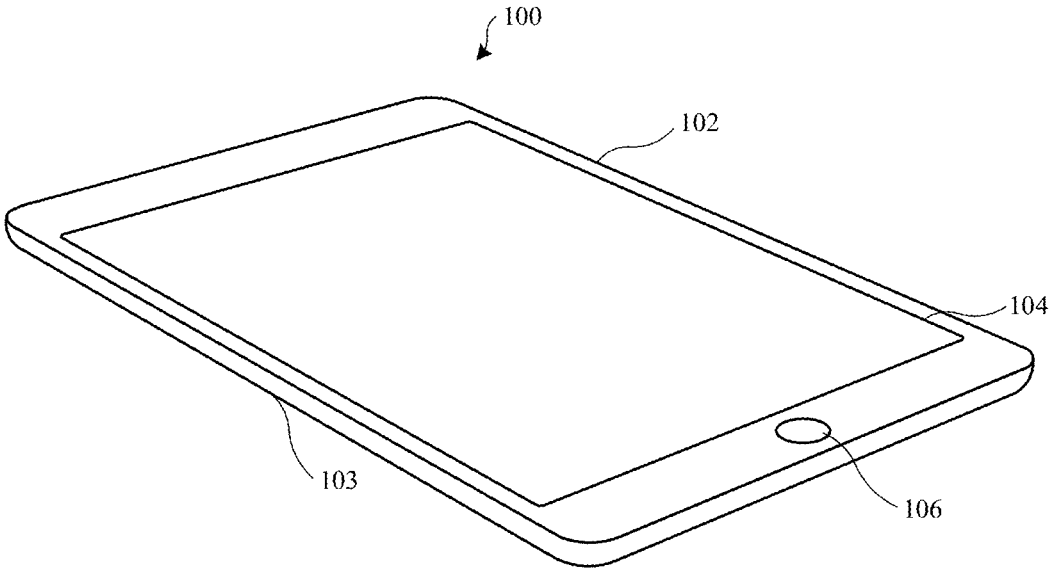
FIG. 1B illustrates in front perspective view the exemplary electronic device of FIG. 1A according to various embodiments of the present disclosure.

Turning first to FIGS. 1A and 1B, an exemplary consumer electronic device is illustrated in top plan and front perspective views. Electronic device 100 can be a tablet computing device, for example, although other similar types and varieties of electronic devices can also apply for the various disclosed components and features disclosed herein. Electronic device 100 can include an outer housing 102 having a device coupling surface 103 or region suitable for coupling an associated accessory or accessory device (not shown). Outer housing 102 can be adapted to hold various processing and electronic components inside, and can also provide space for an exterior touchscreen or other display 104, and one or more buttons 106, among other possible device components.

Figure 2A:
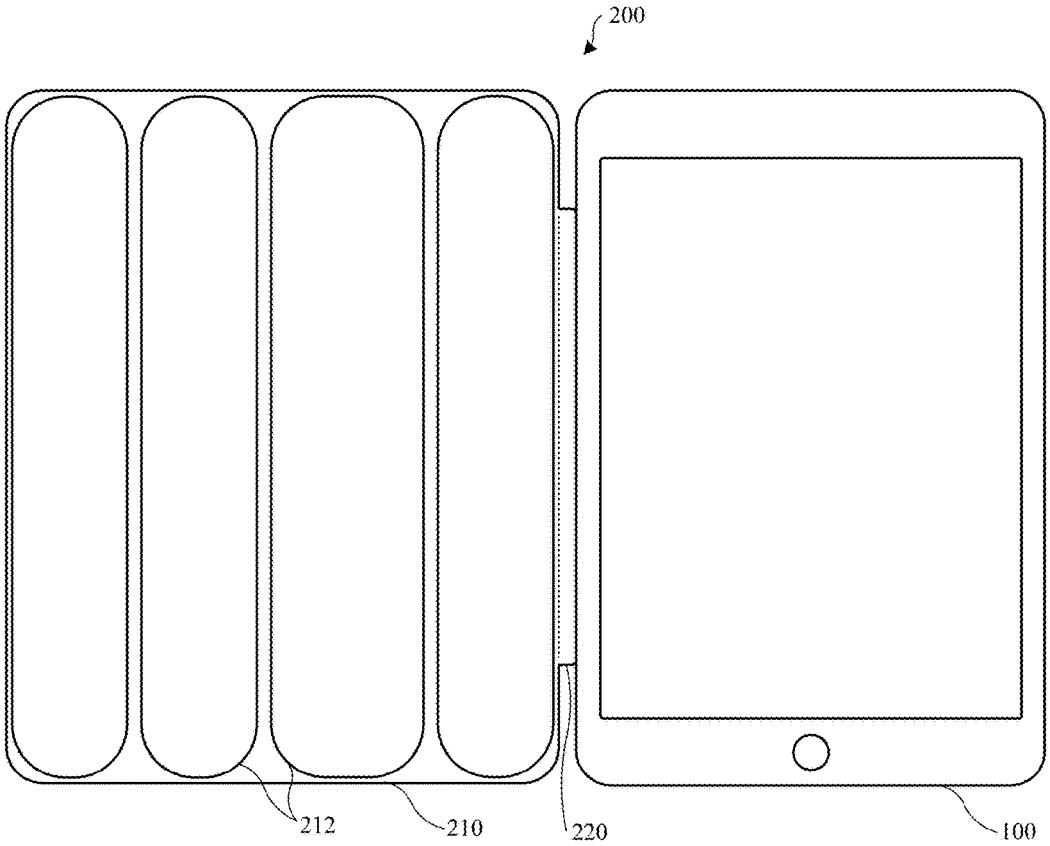
FIG. 2A illustrates in top plan view the exemplary electronic device of FIG. 1A and an associated accessory device coupled thereto in a wide-open configuration according to various embodiments of the present disclosure.

Continuing with FIG. 2A the exemplary electronic device of FIG. 1A and an associated accessory device coupled thereto in a wide-open configuration is shown in top plan view according to various embodiments of the present disclosure. Wide-open configuration 200 can involve electronic device 100 being coupled to an accessory device 210, which can be, for example, a smart cover or other accessory adapted to cover the touchscreen or other display of the electronic device 100. Accessory device 210 can be adapted to provide additional functionalities and/or features with respect to the electronic device 100, as is generally known. Accessory device 210 can include a plurality of flaps 212 or foldable sections, and can couple to the electronic device 100 at a coupling component 220, which can include at least a magnetic attachment feature and a hinge, among other possible components.

Figure 2B:
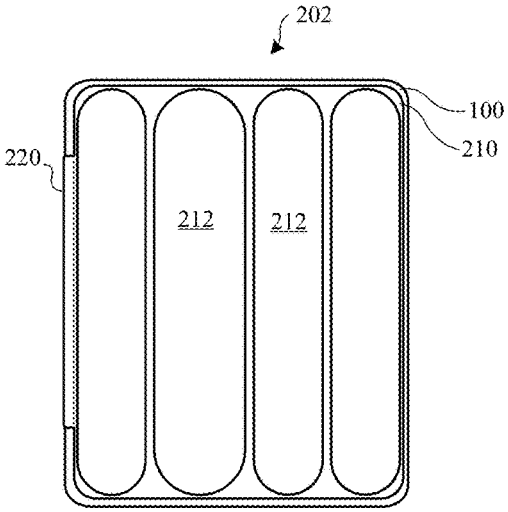
FIG. 2B illustrates in top plan view the exemplary electronic device and accessory device combination of FIG. 2A in a fully closed configuration according to various embodiments of the present disclosure.
Figure 2C:
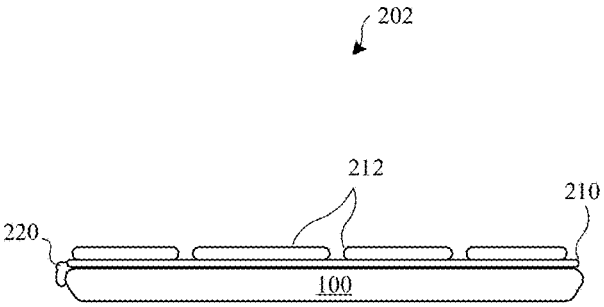
FIG. 2C illustrates in side elevation view the exemplary electronic device and accessory device combination of FIG. 2A in a fully closed configuration according to various embodiments of the present disclosure.

FIGS. 2B and FIG. 2C illustrate in top plan and side elevation views the exemplary electronic device and accessory device combination of FIG. 2A in a fully closed configuration according to various embodiments of the present disclosure. Fully closed configuration 202 can similarly involve electronic device 100 coupled to accessory device 210, such as about a coupling component 220. Again, accessory device 210 can include a plurality of flaps 212 or foldable sections, such that only portions of the whole electronic device display can be exposed or covered, as is known. Further known accessory functions and features may also apply.

Figure 3A:
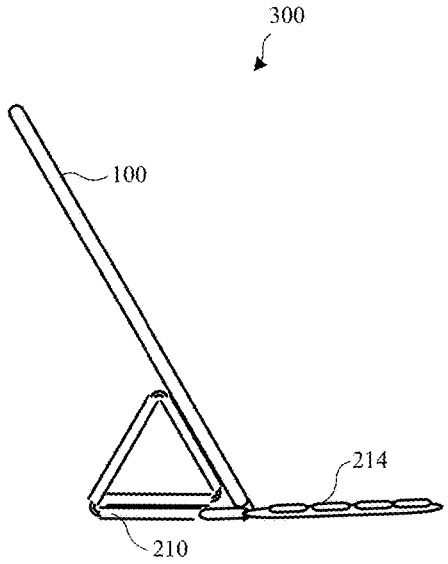
FIG. 3A illustrates in side elevation view the exemplary electronic device and accessory device combination of FIG. 2A in a keyboard mode configuration according to various embodiments of the present disclosure.
Figure 3B:
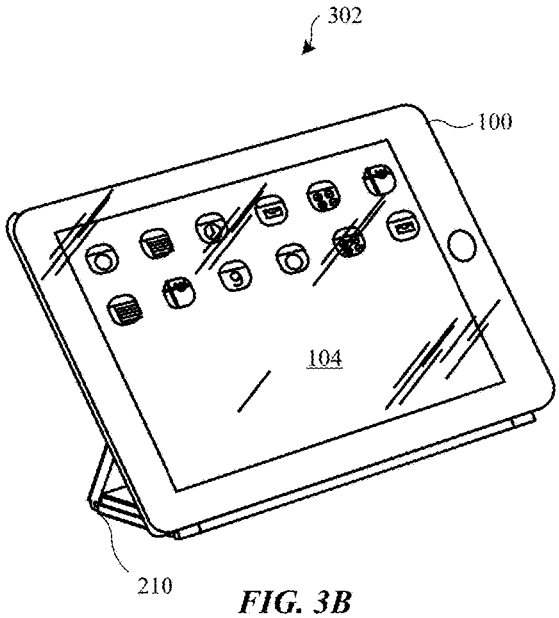
FIG. 3B illustrates in front perspective view the exemplary electronic device and accessory device combination of FIG. 2A in a display mode configuration according to various embodiments of the present disclosure.
Figure 3C:
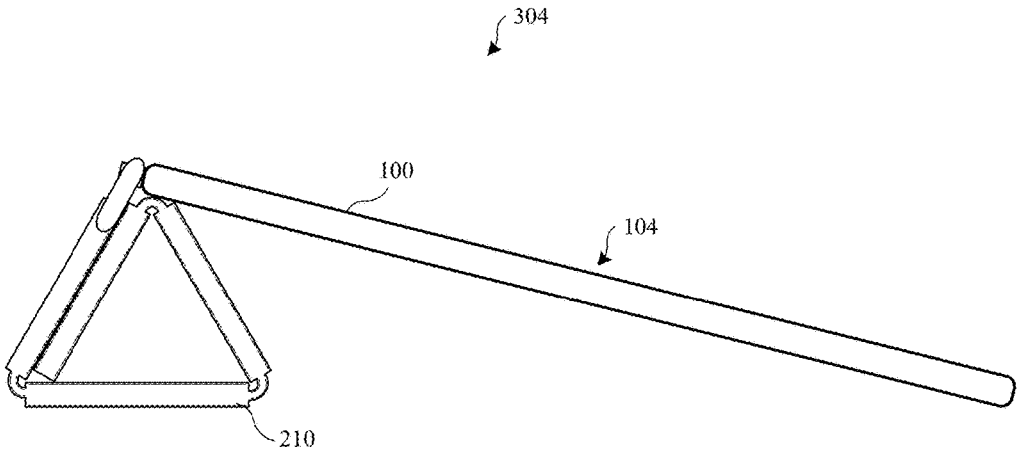
FIG. 3C illustrates in front perspective view the exemplary electronic device and accessory device combination of FIG. 2A in a typing mode configuration according to various embodiments of the present disclosure.

Alternative configurations for the exemplary electronic device and accessory device combination of FIG. 2A are shown in FIGS. 3A-3C. FIG. 3A depicts in side elevation view the electronic device 100 coupled to the accessory device 210 in a keyboard mode configuration 300 that can be particularly suited for using a keyboard. As shown, accessory device 210 can be folded into an arrangement that supports the electronic device 100 in an upright position at a high angle, while a physical keyboard 214 located at or integrated into the accessory device 210 at a readily usable flat position in front of the display 104 on the electronic device 100. FIG. 3B depicts in front perspective view the electronic device 100 coupled to the accessory device 210 in a display mode configuration 302 that can be particularly suited for watching video or other media. As shown, accessory device 210 can be folded into an arrangement that supports the electronic device 100 in an upright position at a medium angle, such that the display 104 on the electronic device 100 can be readily viewed for display watching. FIG. 3C depicts in side elevation view the electronic device 100 coupled to the accessory device 210 in a typing mode configuration 304 that can be particularly suited for typing or using a stylus. As shown, accessory device 210 can be folded into an arrangement that supports the electronic device 100 in an lowered position at a low angle, such that the touchscreen function on display 104 can be used for direct typing or stylus use.

As will be readily appreciated, accessory device 210 can be coupled to the electronic device 100 at coupling component 220 for each of the various configurations and modes illustrated above, as well as for further configurations and modes not shown for purposes of brevity. The coupling between the accessory device 210 and the electronic device 100 can be magnetic in nature, and can be arranged such that the accessory device 210 can be removed from the electronic device 100 simply by providing enough force to overcome the magnetic coupling and pull the two devices apart. Further, the magnetic coupling at coupling component 220 can remain in place as the accessory device 210 is folded, moved, and repositioned across various different configurations involving the electronic device 100, such as those illustrated above. In various embodiments, most or all of the coupling force, alignment, and hold experienced between the accessory device 210 and the electronic device 100 can be provided by way of magnets located at or about the two devices. In some embodiments, the alignment and hold provided by magnets only can be proper within tight enough tolerances such that electrical contacts can be maintained between the accessory device 210 and the electronic device 100, as set forth in detail below.

Figure 4:
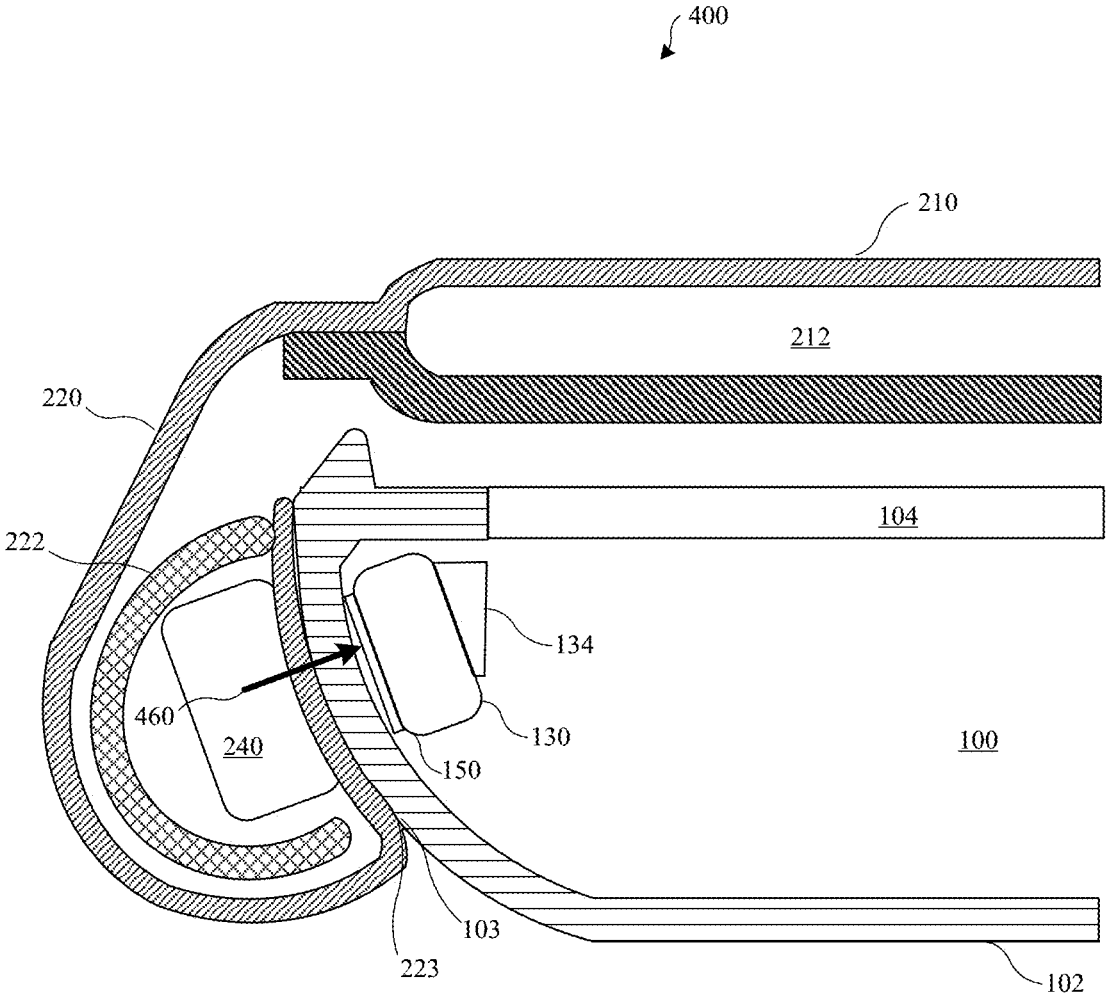
FIG. 4 illustrates in side cross-sectional view an exemplary magnetically aligned accessory to device connection according to various embodiments of the present disclosure.

Transitioning to FIG. 4, an exemplary magnetically aligned accessory to device connection according to various embodiments of the present disclosure is illustrated in side cross-sectional view. Configuration 400 can include an accessory device 210 to an electronic device 100 at a coupling component 220. Again, accessory device 210 can be a smart cover, for example, and can include flaps 212 or foldable sections, which can be used to partially or fully cover a display 104 of the electronic device 100. A coupling component 220 can be integrally formed or otherwise coupled to accessory device 210, and can include a hinge (not shown) a support member 222 configured to support and hold at fixed positions a plurality of magnets 240 disposed therein. An accessory coupling surface 223 can be disposed proximate the plurality of magnets 240 and can facilitate a magnetic coupling between the accessory device 210 and the electronic device 100. In various embodiments, the plurality of magnets 240 can form a magnet array having a pattern, as set forth in detail below.

Electronic device 100 in configuration 400 can have a plurality of magnets 130 that matches or corresponds to the plurality of magnets 240 at the accessory device 210. A device coupling surface 103 that is located along outer housing 102 can be disposed proximate the plurality of magnets 130, and can facilitate a magnetic coupling between the electronic device 100 and the accessory device 210, such as along accessory coupling surface 223 thereof. The plurality of magnets 130 can similarly form a magnet array having a pattern, as set forth in detail below. In addition, one or more shunts 150 can be situated between the plurality of magnets 130, such that the overall magnetic flux at one or more surfaces of the electronic device is reduced. One or more carriers 134 can be used to position and/or hold the plurality of magnets 130 at a fixed location within the electronic device 100. Such carrier(s) 134 can be non-ferrous or non-magnetic. The plurality of magnets 130 and plurality of magnets 240 can have an attraction force 460 therebetween based on their relative alignments and positions with respect to each other. Since attraction force 460 is perpendicular or normal to a general plane or area of contact where accessory coupling surface 223 contacts with device coupling surface 103, attraction force can be a "Z-component" force acting to couple the accessory device 210 to the electronic device 100. In various embodiments, this Z-component attraction force 460 can be sufficient to support the weight of the electronic device 100 when only the accessory device 210 is held, or vice-versa. Also, the attraction force 460 can vary depending upon the orientation, position, and alignment of the accessory device 210 with respect to the electronic device 100, due to the magnet array patterns.

Figure 5A:
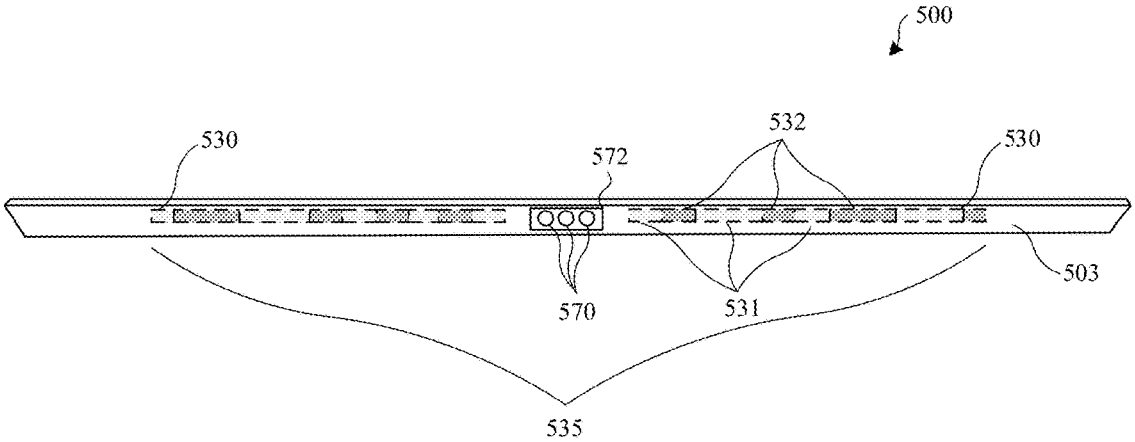
FIG. 5A illustrates in side elevation view an exemplary electronic device having various components for forming a magnetically aligned accessory to device connection according to various embodiments of the present disclosure.

FIG. 5A illustrates in side elevation view an exemplary electronic device having various components for forming a magnetically aligned accessory to device connection according to various embodiments of the present disclosure. Electronic device 500 can be the same or substantially similar to electronic device 100 above in some embodiments. A device coupling surface 503 can provide a region where an associated accessory device (not shown) couples to the electronic device 500. A first magnet array 535 can be disposed behind and proximate to device coupling surface 503 and can include a first plurality of magnets 530 having different lengths from each other. Some or all of the first plurality of magnets 530 can connect to, contact, or be disposed next to each other, and the first plurality of magnets 530 can be arranged in a first pattern of alternating polarities that forms a straight line, as shown. The first plurality of magnets 530 can include multiple first polarity magnets 531 that form the first pattern of alternating polarities with multiple second polarity magnets 532. The first polarity can be positive or north, while the second polarity can be negative or south, as will be readily understood.

In various embodiments, first magnet array 535 can be discontinuous about an inner point or region, such as at the center. Accordingly, first magnet array 535 may be broken into two or more separate continuous segments of magnets arranged in patterns of alternating polarities. One or more electrical contacts 570 can be disposed proximate the first magnet array 535. For example, three separate electrical contacts 570 can be located together as a set at a central region of first magnet array 535 such that two separate continuous segments of magnets are formed on both sides of the set of electrical contacts 570. An insulator region 572 may include a non-conductive material that can be disposed around one or more of the electrical contacts 570 to prevent electrical shorting or other issues. Insulator region 572 can isolate electrical contacts 570 from each other, and also from the housing material at device coupling surface 503 in the event that this is formed from a conductive material, such as aluminum.

Figure 5B:
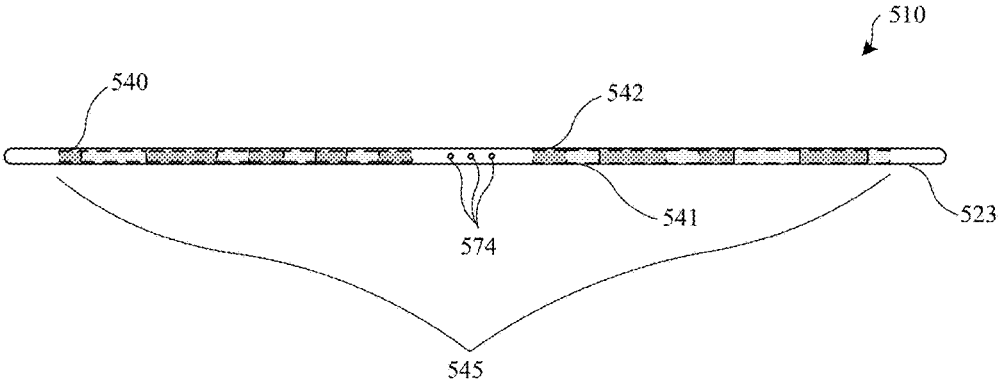
FIG. 5B illustrates in side elevation view an exemplary accessory device having various components for forming a magnetically aligned accessory to device connection according to various embodiments of the present disclosure.

FIG. 5B illustrates in side elevation view an exemplary accessory device having various components for forming a magnetically aligned accessory to device connection according to various embodiments of the present disclosure. Accessory device 510 can be the same or substantially similar to accessory device 210 above in some embodiments. Further accessory device 510 can be configured or suitable for coupling with electronic device 500 in FIG. 5A. An accessory coupling surface 523 can provide a region where an associated electronic device, such as electronic device 500, couples to the accessory device 510. A second magnet array 545 can be disposed behind and proximate to accessory coupling surface 523 and can include a second plurality of magnets 540 having different lengths from each other. Some or all of the second plurality of magnets 540 can connect to or abut each other, and the second plurality of magnets 540 can also be arranged in a pattern of alternating polarities that forms a straight line, as shown. The second plurality of magnets 540 can also include multiple first polarity magnets 541 that form a second pattern of alternating polarities with multiple second polarity magnets 542. As in the case of first and second polarity magnets 531, 532 above, the first polarity can be positive or north, while the second polarity can be negative or south. In various embodiments, the second pattern of alternating polarities can correspond to and even be an inverse of the first pattern of alternating polarities.

Similar to first magnet array 535 above, second magnet array 545 can also be discontinuous about an inner point or region, such as at the center. Second magnet array 545 may thus be broken into two or more separate continuous segments of magnets arranged in patterns of alternating polarities. One or more pins 574 can be disposed proximate the second magnet array 545. For example, three separate pins 574 can be located together as a set at a central region of second magnet array 545 such that two separate continuous segments of magnets are formed on both sides of the set of the pins 574. In various embodiments, the set of pins 574 on the accessory device 510 can correspond to the set of electrical contacts 570 on the electronic device 500. When the accessory device 510 is properly aligned and coupled to the electronic device 500 as set forth herein, the pins 574 can contact the electrical contacts 570 such that an electrical connection is formed and held between the pins and contacts. In this manner, the plurality of pins 574 and the plurality of electrical contacts combine to provide conduits for electrical connectivity between the accessory device 510 and the electronic device 500.

Figure 5C:
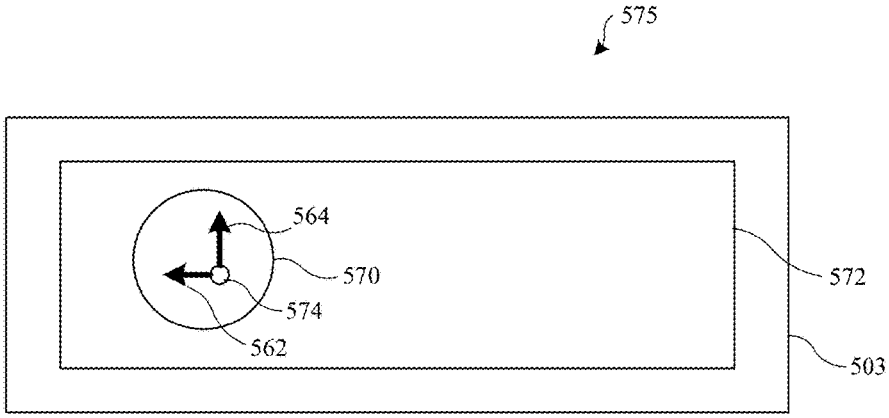
FIG. 5C illustrates in side elevation view an exemplary pin to electrical contact arrangement for a magnetically aligned accessory to device connection according to various embodiments of the present disclosure.

FIG. 5C illustrates in side elevation view an exemplary pin to electrical contact arrangement for a magnetically aligned accessory to device connection according to various embodiments of the present disclosure. Arrangement 575 depicts a pin 574 that is contacting an electrical contact 570 to form an electrical connection between an accessory device and an electronic device. Again, an isolator region 572 can electrically isolate the pin 574 and electrical contact 570 arrangement, such that interference or shorting is not experienced with any other pins, electrical contacts, or a device coupling surface 503 that may be conductive. Friction forces between the pin 574 and electrical contact 570 can include an "X-component" friction force 562 and a "Y-component" friction force 564. These friction forces 562, 564 are forces that may be readily overcome by magnetic forces that are adapted to align and to couple the magnetic arrays automatically. This automatic alignment and coupling between first magnet array 535 and second magnet array 545 then also serves to automatically align and couple the accessory device 510 with the electronic device 500.

Figure 6A:
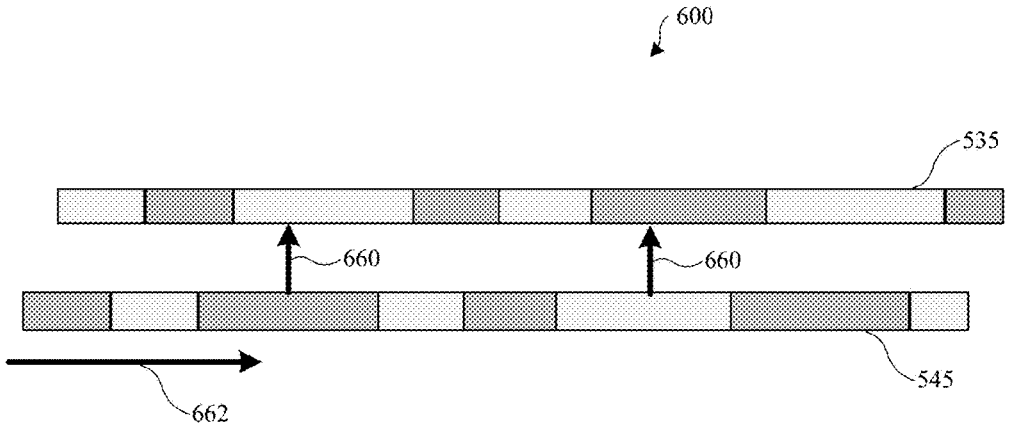
FIG. 6A illustrates in side elevation view exemplary magnet arrays having a horizontal offset and resulting horizontal force therebetween according to various embodiments of the present disclosure.

FIG. 6A illustrates in side elevation view exemplary magnet arrays having a horizontal offset and resulting horizontal force therebetween according to various embodiments of the present disclosure. Arrangement 600 can include a first magnet array 535 and a second magnet array 545 that are configured to interact with each other. In some embodiments, the first magnet array 535 can be configured to be used within an electronic device, while the second magnet array 545 can be configured to be used within an accessory device that couples to the electronic device. Further, the magnet arrays can each form a pattern of alternating polarities, and the patterns can be inverses of each other.

Attraction forces 660 between complementary magnets in each magnet array can pull the second magnet array 545 toward the first magnet array 535. As shown, however, there can be a horizontal offset between the alignment of the first and second magnet arrays. In such cases, the attraction forces 660 will not exist all along the arrays, but only at those locations where opposite magnets overlap. For some regions, similar magnets will overlap due to the overall horizontal offset. This can then result in a repelling force at those regions. The overall combination of attraction and repelling forces along the magnet arrays results in a horizontal correction force 662, which can function to align the magnet arrays properly. The magnitude of this horizontal correction force 662 can be a function of the number of different magnets there are in the alternating polarity pattern within each magnet array. With more magnets arranged into instances of alternating polarity along the magnet array, the overall horizontal correction force 662 can increase. This is because the increase in alternating polarities then results in an increase for the number of places where repelling forces are acting against the magnet arrays to force them into the proper alignment.

Figure 6B:
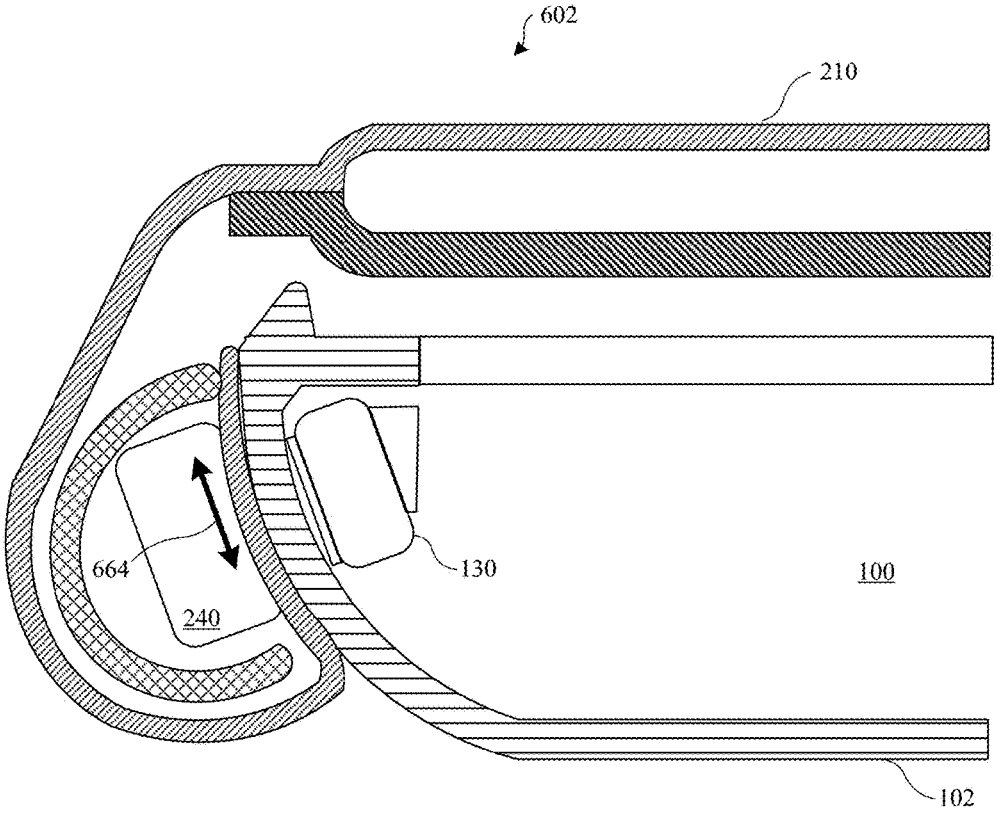
FIG. 6B illustrates in side cross-sectional view an exemplary magnetically aligned accessory to device connection having a vertical force at a magnet array thereof according to various embodiments of the present disclosure

FIG. 6B illustrates in side cross-sectional view an exemplary magnetically aligned accessory to device connection having a vertical force at a magnet array thereof according to various embodiments of the present disclosure. Arrangement 602 can be identical or substantially similar to configuration 400 above, for example. As shown, a plurality of magnets 130 in electronic device 100 and a plurality of magnets 240 in accessory device 210 can be arranged such that they attract each other and create a coupling between the devices. A vertical force component 664 can largely depend upon how tall the magnets are in the magnet arrays. Where the magnets are tall, the amount of vertical force or corresponding relative movement in that direction can be large. Where the magnets are short, there is a reduced amount of height or space for the magnets to attract and couple to each other. Accordingly, it is preferable to have shorter magnets so as to limit the amount of possible movement or misalignment along the direction of vertical force component 664.

Figure 7A:
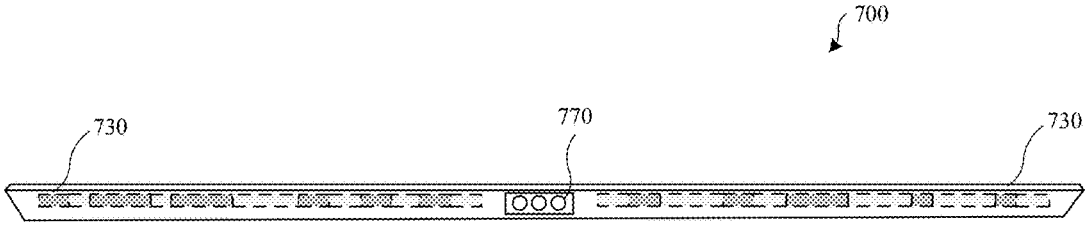
FIG. 7A illustrates in side elevation view an exemplary electronic device having a full-length magnet array for forming a magnetically aligned accessory to device connection according to various embodiments of the present disclosure.

FIG. 7A illustrates in side elevation view an exemplary electronic device having a full-length magnet array for forming a magnetically aligned accessory to device connection according to various embodiments of the present disclosure. Electronic device 700 can be similar to electronic device 500 above in some embodiments. One or more electrical contacts 770 can be disposed within a magnet array having a plurality of individual magnets 730, which can be disposed behind and proximate to a surface of electronic device 700. Electronic device 700 can be full-sized, such that the magnets 730 can form a full-length magnet array. Again, the magnet array can include a pattern of alternating polarities.

Figure 7B:
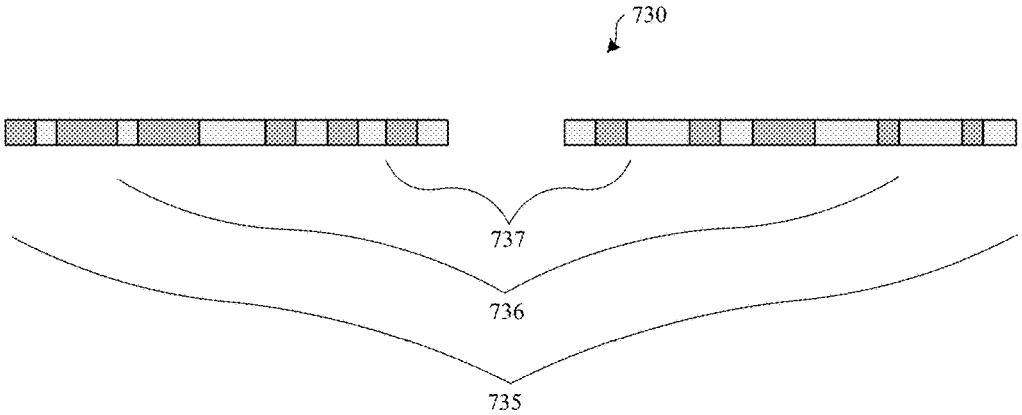
FIG. 7B illustrates in side elevation view the full-length magnet array of FIG. 7A according to various embodiments of the present disclosure.

FIG. 7B illustrates in side elevation view the full-length magnet array of FIG. 7A according to various embodiments of the present disclosure. Plurality of magnets 730 form a full-length magnet array 735 when taken in their entirety. Overall, magnet array 735 can be asymmetric about an inner point, such as a center point. This can result in an inability for the magnet array 735 to couple in a properly aligned manner with a corresponding magnet array when the magnet array 735 is reversed or flipped. A shortened or truncated portion 736 of magnet array 735 can also be asymmetric about an inner or central point. In various embodiments, the overall magnet array 735 can include an inner portion 737 that also has alternating polarities for multiple magnets.

Unlike overall magnet array 735 and truncated portion 736, however, inner portion 737 can be symmetric about an inner or central point. In this particular illustrative example, inner portion 737 of magnet array 735 can have four magnets or magnetic sections that are symmetric about a central point. An outer portion for magnet array 735 can include all portions of the magnet array that are not inner portion 737, or may simply include those portions that are within truncated portion 736 and are not inner portion 737. In such instances, the outer portion can include at least four additional magnets or magnetic sections that are asymmetric about the central point. Of course, 5, 8, 10, or more magnets or magnetic sections may also be included.

By having an asymmetric pattern about an inner or central point, the overall magnet array patterns work to encourage and better support orientations, alignments, and couplings that are proper according to device design and aesthetics. Where the accessory device is reversed or flipped in orientation, certain alignments may still result in some magnetic attraction force between the accessory and electronic device, but such attraction forces will be far lower than a normalized attraction force that is achievable only at a single intended orientation and alignment of the accessory and electronic device with each other. Further, the magnet array patterns can be designed such that even where some attraction force exists and can weakly hold or couple the accessory to the electronic device in a reversed or flipped orientation, the actual alignment can be slightly but noticeably offset. Thus, there can be both a reduced amount of attraction force and also an obvious offset between the devices for any coupling using an improper orientation, such that a user would be readily aware that something is not right.

Due to the asymmetric matching magnet patterns on both the accessory and the electronic device, the intended orientation and alignment of the two devices can result in the normalized attraction force that represents the maximum amount of magnetic attraction force achievable between the two magnet arrays in the respective devices. At other orientations and/or alignments, a lower magnetic attraction force may be observed between the two magnet arrays. At still other orientations and/or alignments, a magnetic repelling force may be observed. Regardless of the orientation and/or alignment, only the proper or intended orientation and alignment results in a magnetic attraction force that is even close to the maximum possible or normalized attraction force. In various embodiments, every other orientation and alignment results in either a repelling force, or an attraction force that is no greater than one-half of the normalized attraction force. In some embodiments, no greater than one-third of the normalized attraction force can be achieved at any alignment and/or orientation that is not the proper or intended orientation and alignment.

Figure 7C:
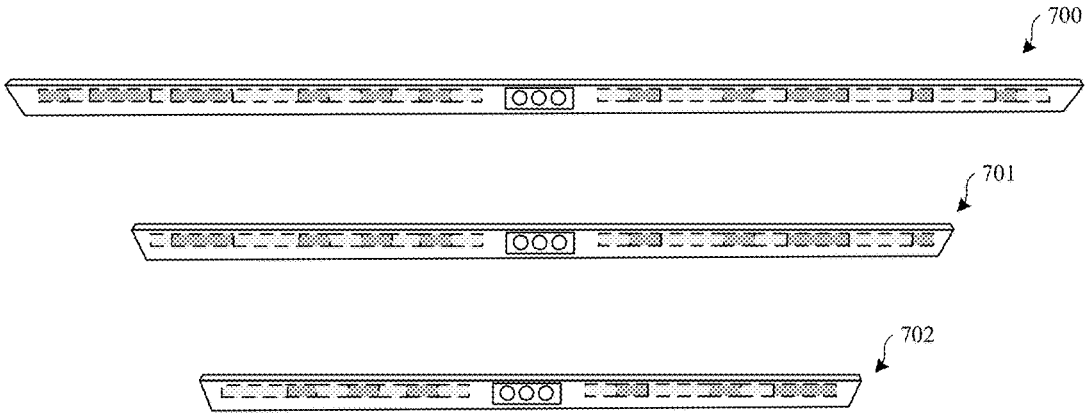
FIG. 7C illustrates in side elevation view an exemplary series of electronic devices having varying length magnet arrays for forming magnetically aligned accessory to device connections according to various embodiments of the present disclosure.

FIG. 7C illustrates in side elevation view an exemplary series of electronic devices having varying length magnet arrays for forming magnetically aligned accessory to device connections according to various embodiments of the present disclosure. Electronic device 700 can be a full-size electronic device, such that it has a full-length magnet array disposed therewithin. Electronic device 701 can be a mid-sized electronic device, such that it has a mid-sized or truncated magnet array disposed therewith. Electronic device 702 can be a small sized electronic device, such that it has a short magnet array disposed therewithin. As can be seen in FIG. 7C, the pattern for each magnet array can be the same with respect to the center or other inner point of the magnet array. The only differences between magnet arrays then can be with respect to their lengths, with shorter magnet arrays simply not having additional magnets toward the ends of their arrays. With respect to the center and nearby regions of each magnet array, these portions can all be identical with respect to the magnets that are there.

In essence, the longer magnet array patterns are extensions of the shorter magnet array patterns, with the portions that match the shorter lengths having the same pattern for those portions or lengths. With the patterns of the different sized magnet arrays being arranged in this manner, there can still be significant functionality for magnetic coupling and electrical connection formation and holding even where different sized electronic devices and accessory devices are used, since at least the central portions of the magnet arrays for each such device will still match and be able to facilitate some form of alignment and coupling. In the event that the longer magnet array patterns are used by both devices and can be taken advantage of, then greater amounts of magnetic attraction can be observed.

Figure 8A:
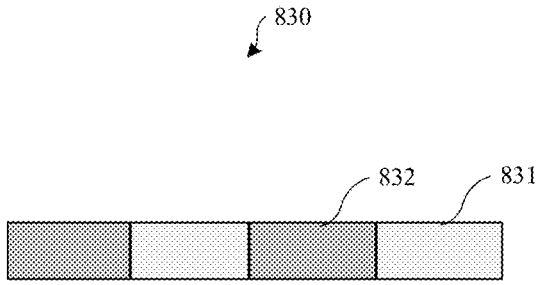
FIG. 8A illustrates in front elevation view an exemplary magnetic arrangement for a magnetically aligned accessory to device connection according to various embodiments of the present disclosure.

Although it can be useful for increasing magnetic forces and conserving space, various issues can be observed by placing multiple magnets in contact with or in close proximity with each other when forming a magnetic array. FIG. 8A illustrates in front elevation view an exemplary magnetic arrangement for a magnetically aligned accessory to device connection according to various embodiments of the present disclosure. Magnetic arrangement 830 can include first polarity magnets 831 and second polarity magnets 832 arranged into a pattern of alternating polarities. In particular, magnets 831 and 832 are arranged such that they are either in contact or are in close proximity with each other.

Figure 8B:
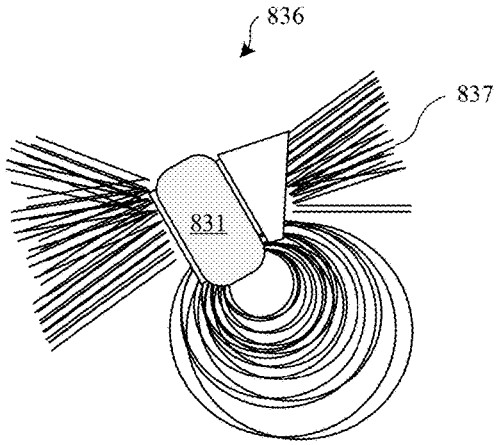
FIG. 8B illustrates in side elevation view an exemplary magnetic flux density field for a portion of the magnetic arrangement of FIG. 8A according to various embodiments of the present disclosure.

FIG. 8B illustrates in side elevation view an exemplary magnetic flux density field for a portion of the magnetic arrangement of FIG. 8A. Magnetic arrangement portion 836 can include a first polarity magnet 831 that is in contact or close proximity with one or more second polarity magnets (not shown). As a result, a relatively large magnetic flux density field 837 can be generated, particular at the locations where first polarity magnet 831 contacts or is next to second polarity magnet(s). Having this large magnetic flux density field 837 can be helpful for added magnetic strength, but can also be problematic with respect to other items. For example, credit cards and/or other magnetic components located outside of the respective electronic device, such as at a surface thereof, can be affected by such a large magnetic flux. In some cases, such as large magnetic flux can erase or otherwise destroy data on magnetic stripe cards.

Figure 8C:
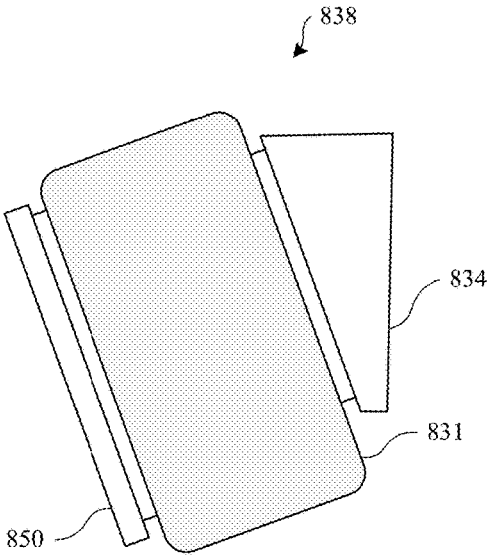
FIG. 8C illustrates in side elevation view an exemplary shunt and magnet arrangement for the portion of the partial magnetic arrangement of FIG. 8B according to various embodiments of the present disclosure.

FIG. 8C illustrates in side elevation view an exemplary shunt and magnet arrangement for the portion of the partial magnetic arrangement of FIG. 8B according to various embodiments of the present disclosure. Magnetic arrangement 838 can again include a first polarity magnet 831 that may be in contact with or in close proximity to one or more second polarity magnets (not shown), such that a large magnetic flux density field might be generated. A carrier 834 can be located at a back side of first polarity magnet 831, such as to hold the magnet at a fixed position within its respective device. In addition, a shunt 850 can be located at or about a front surface of the first polarity magnet 831. Shunt 850 can be formed from a ferrous or other suitable material in order to block or shield a magnetic flux density field from extending away from first polarity magnet 831 to an exterior surface of its respective device. In this manner, magnets within a magnet array can be placed in contact or close proximity to each other to create higher magnetic flux density fields, and these higher fields are still effectively shielded from affecting other items outside of the respective device. Although not shown, a shunt 850 may also be located at or about a back surface of magnet 831 as well.

Figure 8D:
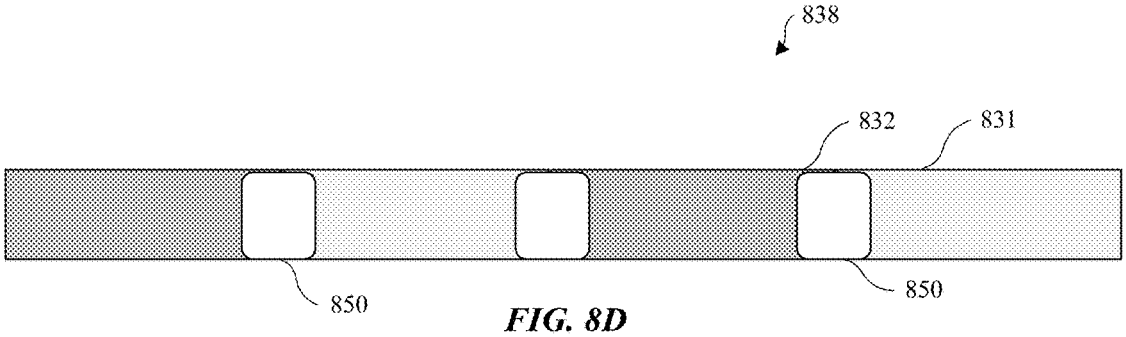
FIG. 8D illustrates in side elevation view an alternative exemplary partial magnetic arrangement for a magnetically aligned accessory to device connection according to various embodiments of the present disclosure.

FIG. 8D illustrates in side elevation view an alternative exemplary partial magnetic arrangement for a magnetically aligned accessory to device connection according to various embodiments of the present disclosure. Magnetic arrangement 838 can be similar to magnetic arrangement 830 above in that it may include first polarity magnets 831 and second polarity magnets 832 arranged into a pattern of alternating polarities. Also similar, magnets 831 and 832 are arranged such that they are either in contact or are in close proximity with each other. In addition, a plurality of shunts 850 can be positioned in front of the magnets 831 and 832, and in particular can be positioned where the magnets meet. In this manner, the large amounts of magnetic flux that can be generated at the intersection of differing polarity magnets can be effectively shielded from causing significant problems outside of the overall device. Again, shunts may also be located behind the magnets 831 and 832 as well, if desired.

Figure 9A:
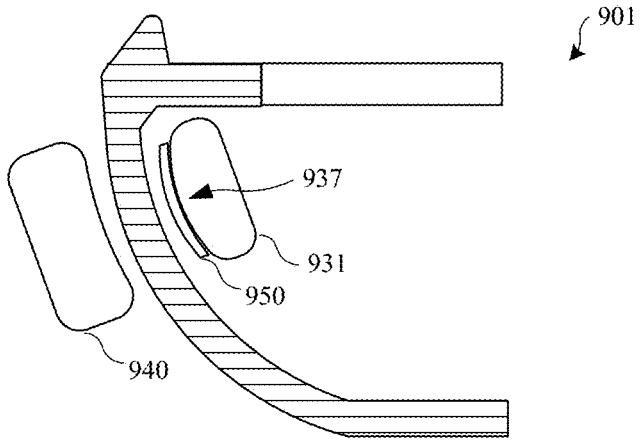
FIG. 9A illustrates in side cross-sectional view an exemplary magnetically connected accessory to device arrangement using a convex magnet according to various embodiments of the present disclosure.

FIG. 9A illustrates in side cross-sectional view an exemplary magnetically connected accessory to device arrangement using a convex magnet according to various embodiments of the present disclosure. Arrangement 901 can be similar to arrangements 602 shown in FIG. 6B and 838 shown in FIG. 8C, with magnets 931 and shunts 950 belonging to the electronic device, and magnets 940 belonging to the accessory device. As shown, one or more of magnets 931 can have a mating surface 937 that is convex in nature. In such arrangements, it can be preferable to shield or otherwise control magnetic flux at the ends of the magnets by using shunts 950, such as by that which is shown in FIGS. 8C and 8D. Unfortunately, the use of shunts at the ends of the magnets can result in an effective loss of force or utility across a full array of alternating magnets. Accordingly, other ways of controlling flux at the ends of the magnets may allow for a more robust use of a full magnet array while still allowing the ends of alternating magnets to abut or be relatively close to each other.

Figure 9B:
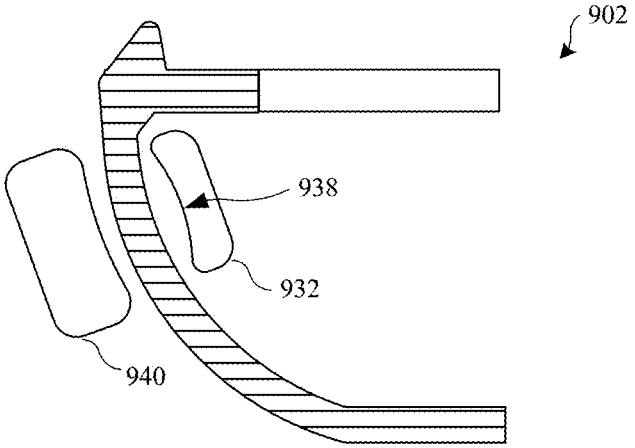
FIG. 9B illustrates in side cross-sectional view an exemplary magnetically connected accessory to device arrangement using a thin concave magnet according to various embodiments of the present disclosure.

FIG. 9B illustrates in side cross-sectional view an exemplary magnetically connected accessory to device arrangement using a thin concave magnet according to various embodiments of the present disclosure. Arrangement 902 can be similar to arrangement 901 above, with a notable exception of the magnet shape in the electronic device. As shown, one or more of magnets 932 can have a mating surface 938 that is concave in nature. In such arrangements, the specific shape of the magnet at concave mating surface 938 serves to control magnetic flux at the ends of the magnets without the use of shunts, and without spacing magnets apart. In some embodiments, magnets 932 in the magnet array within the electronic device can abut each other. Magnets 932 can be relatively thin and can be located close to the inner surface of the device within which they are located.

Figure 9C:
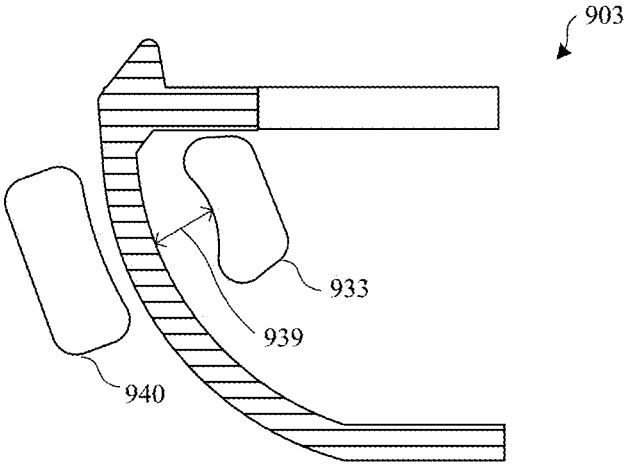
FIG. 9C illustrates in side cross-sectional view an exemplary magnetically connected accessory to device arrangement using a thick concave magnet according to various embodiments of the present disclosure.

FIG. 9C illustrates in side cross-sectional view an exemplary magnetically connected accessory to device arrangement using a thick concave magnet according to various embodiments of the present disclosure. Arrangement 903 can be similar to arrangements 901 and 902 above, with a notable exception of the magnet shape and location in the electronic device. As shown, one or more of magnets 933 can also have a mating surface that is concave in nature. Again, the specific shape of the magnet at concave mating surface 938 serves to control magnetic flux at the ends of the magnets without the use of shunts, and without spacing magnets apart, such as where magnets in the array abut each other. Unlike the relatively thin magnets 932 in arrangement 902, however, magnets 933 in arrangement 903 can be relatively thick and can be located at a distance 939 that is relatively farther away from the inner surface of the device within which they are located. As will be readily appreciated, a magnet that is thicker can be spaced farther away from a mating magnet 940 and still generate more magnetic attraction or force than a thinner magnet that is spaced closer to the mating magnet 940.

In addition to controlling magnetic flux at the ends of each magnet, the specific shape of each magnet can be used for specific control of the amount and location of magnetic force exerted by that magnet. More complex magnet shapes can be used to exert the exact amount of force desired. Such complex magnet shapes can help to facilitate alignment control of one magnet array onto another in both X and Y (lateral and vertical) directions, if desired.

Figure 10:
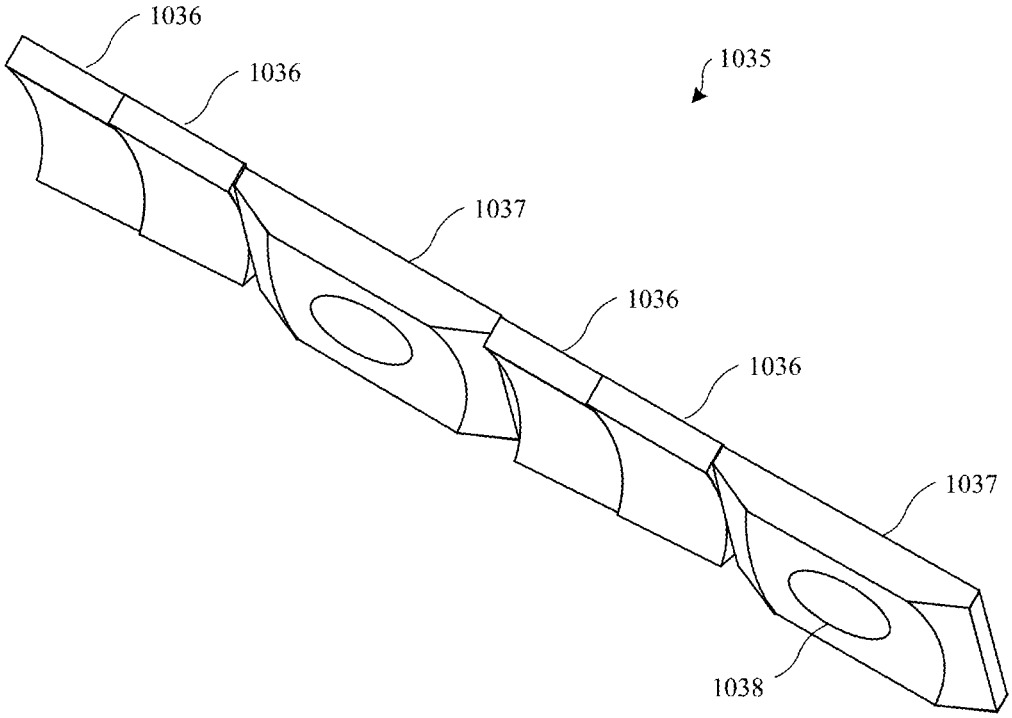
FIG. 10 illustrates in front perspective view an exemplary magnet array portion having short and long concave magnets according to various embodiments of the present disclosure.

FIG. 10 illustrates in front perspective view an exemplary magnet array portion having short and long concave magnets according to various embodiments of the present disclosure. Magnet array portion 1035 can be a portion of a longer full-length magnet array, such as that which is shown in magnet array 735 above, for example. Magnet array portion 1035 can include magnets of alternating polarities as described above, although not illustrated here for purposes of simplicity. Magnet array portion 1035 can include multiple short magnets 1036 and multiple long magnets 1037, both of which can include concave mating surfaces, and both of which can include one or both polarities. As shown, the shape of short magnets 1036 can be relatively simple, and can be substantially similar to magnets 932 or 933 depicted above. The shape of long magnets 1037 can be more complex, and can include thinner or tapered ends, as well as a concave shaped center region 1038. This more complex shape can provide a desired amount of magnetic force while still limiting the amount of flux at the ends of magnets 1037.

Figure 11:
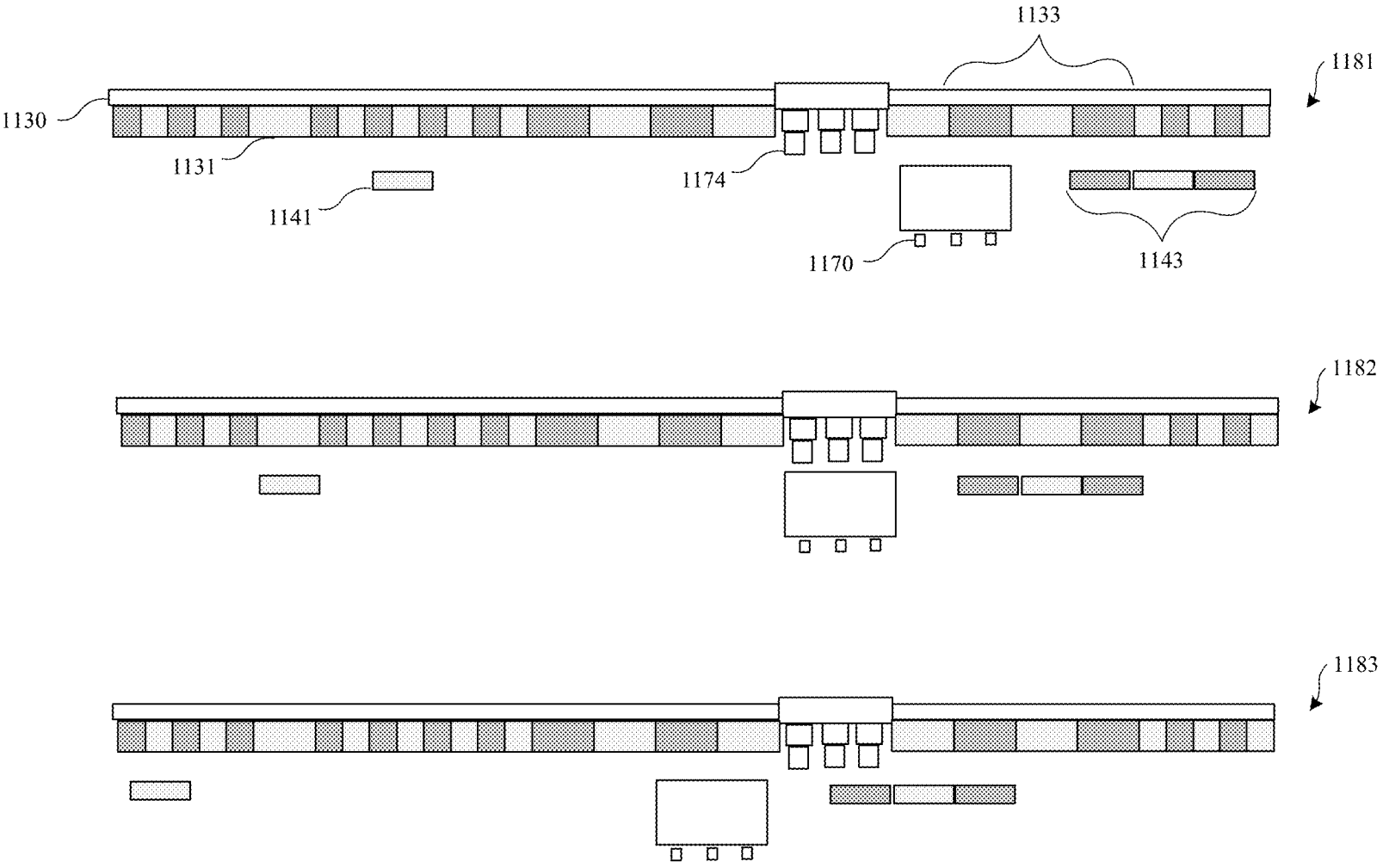
FIG. 11 illustrates in side elevation views various exemplary magnet array displacements for an exemplary magnetically connected accessory to an electronic device arrangement according to various embodiments of the present disclosure.

FIG. 11 illustrates in side elevation views various exemplary magnet array displacements for an exemplary magnetically connected accessory to an electronic device arrangement according to various embodiments of the present disclosure. Arrangement 1181 shows magnet array portion 1130 positioned with respect to several key elements on a corresponding mating magnet array. Although only a portion of a magnet array is shown for purposed of illustration, it will be appreciated that the full magnet array may include additional magnets that extend further from one or both ends of magnet array portion 1130. Magnet array portion 1130, which can be located on an accessory device, for example, can include one or more pins 1174 at a central region, as well as a given magnet 1131 and given magnet combination 1133. The pins 1174 can be designed to align with and contact electrical contacts 1170, while given magnet 1131 can be designed to align with corresponding given magnet 1141, and given magnet combination 1133 can be designed to align with and corresponding given magnet combination 1143. As shown in arrangement 1181, the entire magnet array portion 1130 has an offset or displacement to the left of where it should be aligned with respect to the corresponding mating array. It will appreciated that while only several key elements have been identified on both magnet array portions, the entire magnet array portion is similarly offset by the same displacement amount. This displacement can be a given amount such that there is some magnetic attraction between the offset magnetic elements in both arrays, but not the optimal or maximum magnetic attraction that would exist for an accurate alignment of both magnet arrays. At this arrangement 1181, the magnet arrays will attract and couple to each other, but the amount of offset will clearly indicate that an optimal alignment between the magnet arrays (and corresponding accessory and electronic devices) is not taking place. As one example, this displacement to the left can be on the order of about 10-30 mm. Of course, other offset dimensions or amounts are also possible.

Arrangement 1182 depicts magnet array portion 1130 that is optimally positioned with respect to the key elements on the corresponding mating magnet array. That is, given magnet 1131 aligns directly with corresponding given magnet 1141, pins 1174 align directly with electrical contacts 1170, and given magnet combination 1133 aligns directly with given magnet combination 1143. At this accurate alignment, the mating magnet arrays experience the maximum possible magnetic attraction force, as all magnetic elements are aligned as designed. Arrangement 1183 is similar to arrangement 1181, only with the magnet array portion 1130 having an offset or displacement to the right of where it should be aligned with respect to the corresponding mating array. Again, this displacement can be a given amount such that there is some magnetic attraction between the offset magnetic elements in both arrays, but not the optimal or maximum magnetic attraction that would exist for an accurate alignment of both magnet arrays, and the amount of offset will clearly indicate that an optimal alignment between the magnet arrays is not taking place. As one example, this displacement to the left can be on the order of about 10-30 mm. Of course, other offset dimensions or amounts are also possible.

Figure 12:
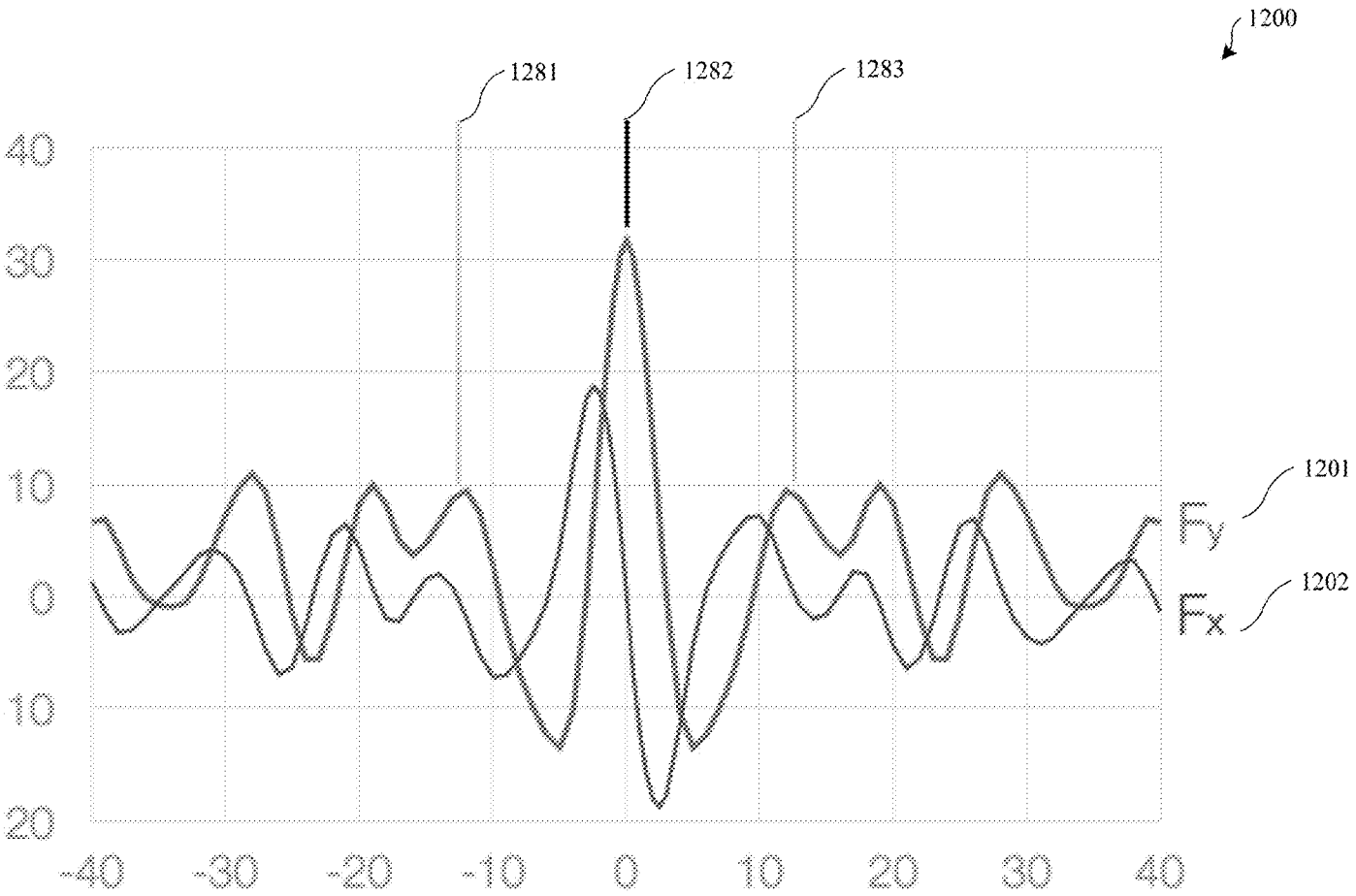
FIG. 12 illustrates a graph of forces based on displacement for an exemplary magnetically connected accessory to an electronic device arrangement according to various embodiments of the present disclosure.

FIG. 12 illustrates a graph of forces based on displacement for an exemplary magnetically connected accessory to an electronic device arrangement according to various embodiments of the present disclosure. The magnetic force can be measured in Newtons, while the displacement can be measured in mm from optimal. Graphed line 1201 can represent $F_y$, which can be the amount of attraction force between the mating magnet arrays. Graphed line 1202 can represent $F_x$, which can be the amount of lateral force experienced in the mating magnet arrays. As will be readily appreciated, the mating magnet arrays will tend to move laterally relative to each other to couple at locations where $F_x$ is zero. Each of displacement positions 1281, 1282, and 1283 can correspond to the previous arrangements 1181, 1182, 1183. As can be seen, the lateral force $F_x$ is zero at each of displacement locations 1281, 1282, 1283, such that these displacements reflect positions or offsets where the magnet arrays naturally move laterally relative to each other for coupling. Of the three displacement positions, clearly optimal position 1282 at zero displacement has the greatest magnetic attraction force $F_y$, since this is the position where all magnetic elements in both arrays are properly aligned with a corresponding proper mating magnetic element. Again, while the magnetic arrays will attract and couple at displacement locations or positions 1281 and 1283, the magnetic attraction force $F_y$ will be noticeably weaker at these locations, and the amount of lateral offset will be noticeable. Other offset or displacement locations may also exist, with the magnetic attraction force being even weaker and the amount of lateral offset being even greater for such other locations.

Figure 13:
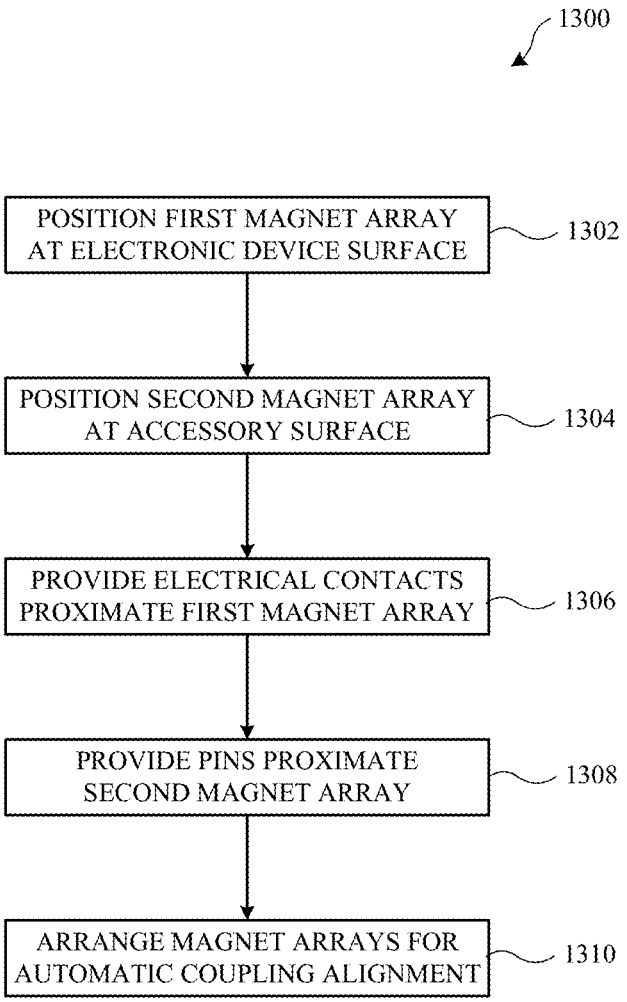
FIG. 13 illustrates a flowchart of an exemplary method for magnetically connecting an accessory to an electronic device according to various embodiments of the present disclosure.

FIG. 13 illustrates a flowchart of an exemplary method for facilitating a magnetically aligned accessory to electronic device connection according to various embodiments of the present disclosure. Method 1300 can include process steps that can be performed entirely by a maker of an accessory or electronic device, entirely by a user of the accessory and electronic device, or entirely a processor configured to facilitate the described use of the accessory and electronic device, among other possibilities. At a first process step 1302, a first magnet array can be positioned proximate to or at a coupling surface of an electronic device. As noted above, the first magnet array can include a first plurality of magnets arranged in a first pattern of alternating polarities. Among other possible arrangements, the first pattern can have an inner portion of alternating polarities that is symmetric about an inner point and an outer portion of alternating pluralities that is asymmetric about the inner point. Further details set forth above regarding the first pattern may also be applied. In some embodiments, the first magnet array can be positioned by being installed or placed within the electronic device, such as by manual or automated assembly. In some embodiments, the first magnet array can be positioned due to handling by a user of the electronic device.

At the next process step 1304, a second magnet array can be positioned proximate to or at a coupling surface of an accessory or accessory device. The second magnet array can include a second plurality of magnets arranged in a second pattern of alternating polarities that corresponds to the first pattern of alternating polarities. Similarly, the second magnet array can be positioned by being installed or placed within the accessory device, or can be positioned due to handling by a user of the accessory device. At process step 1306, a plurality of electrical contacts can be provided proximate the first magnet array at the coupling surface of the electronic device, and at process step 1308, a plurality of pins can be provided proximate the second magnet array at the coupling surface of the accessory device. Similar to the foregoing, these electrical contacts and pins can be provided by being installed or placed at the electronic device and the accessory device respectively, or can be provided due to handling and resulting exposure or arrangement by a user of these devices.

At a subsequent process step 1310, an arrangement can be facilitated such that the first magnetic array and the second magnetic array are automatically coupled at a particular alignment under certain conditions. In particular, the facilitated arrangement results in the second magnet array automatically coupling to the first magnet array with a normalized attraction force at a specifically intended orientation and alignment when the first magnet array is placed near the second magnet array at a general orientation and alignment that is similar to the specific orientation and alignment. In various embodiments, the automatic coupling results in the accessory device being properly oriented and aligned with the associated electronic device to specifically tight tolerances. In particular, the tolerances are tight enough such that the plurality of pins always or almost always aligns with and contacts the plurality of electrical contacts to provide conduits for electrical connectivity between the accessory device and the electronic device as a result of the automatic coupling. Again, this facilitated arrangement can be performed by a maker or a user of the electronic device and accessory device.

For the foregoing flowchart, it will be readily appreciated that not every step provided is always necessary, and that further steps not set forth herein may also be included. For example, added steps that involve alternative couplings at reduced attraction forces for offset distances and/or reversed configurations may be added. Also, steps that provide more detail with respect to the magnet arrays and patterns may also be added. Furthermore, the exact order of steps may be altered as desired, and some steps may be performed simultaneously. For example, steps 902 and 904 may be performed together or in reverse order. Simultaneous performance of all steps may also be possible in some instances.

Figure 14:
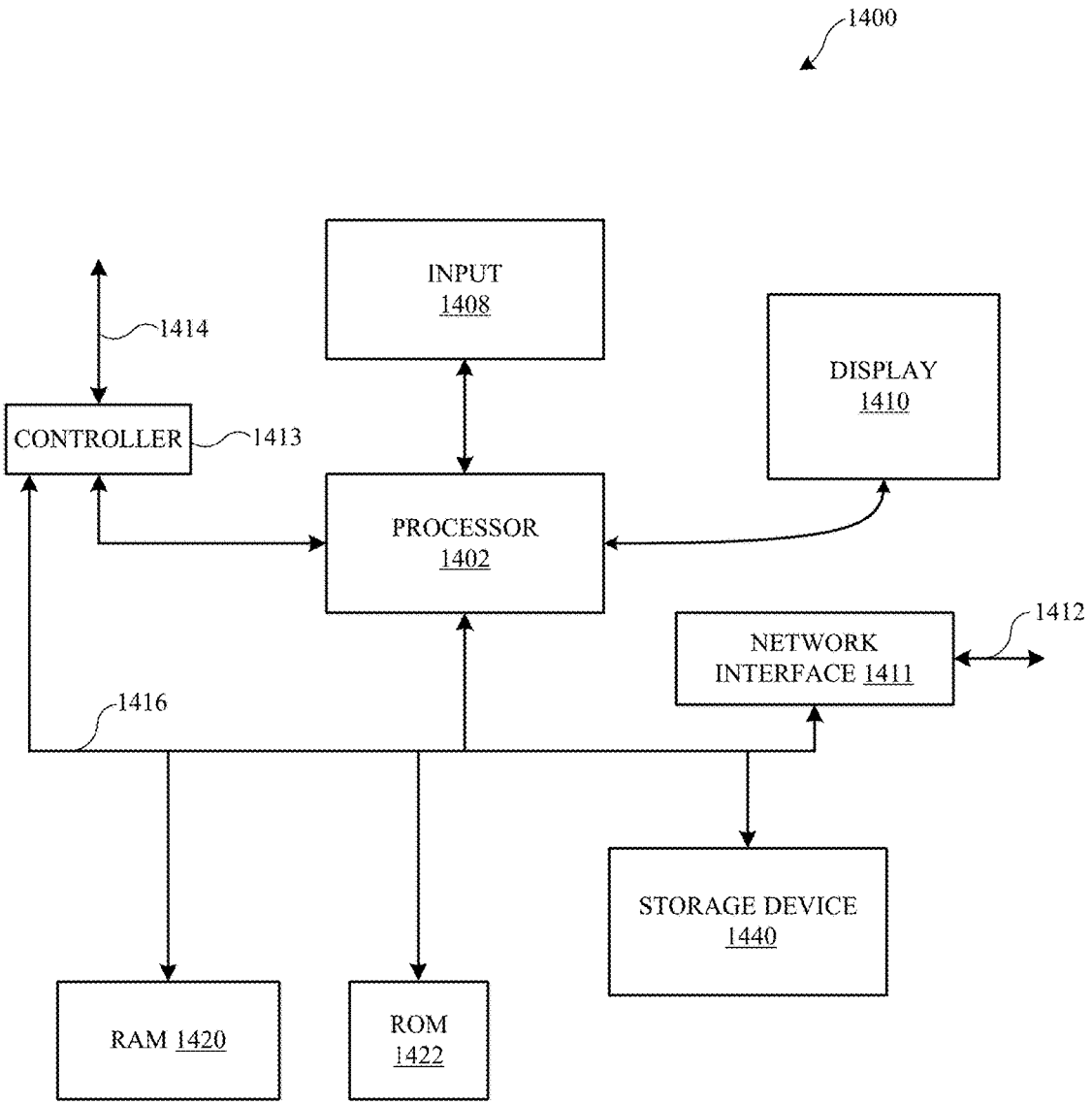
FIG. 14 illustrates in block diagram format an exemplary computing device that can be used to implement the various components and techniques described herein according to various embodiments of the present disclosure.

FIG. 14 illustrates in block diagram format an exemplary computing device 1400 that can be used to implement the various components and techniques described herein, according to some embodiments. In particular, the detailed view illustrates various components that can be included in the electronic device 100 illustrated in FIGS. 1A and 1B. Such components can include various magnetically aligned accessory to device connection items, as well as a processor that facilitates electrical conductivity or communications between the electronic device 100 and an accessory when the electronic device and accessory are magnetically aligned and coupled, such as by way of that which is set forth in the foregoing examples. As shown in FIG. 14, the computing device 1400 can include a processor 1402 that represents a microprocessor or controller for controlling the overall operation of computing device 1400. The computing device 1400 can also include a user input device 1408 that allows a user of the computing device 1400 to interact with the computing device 1400. For example, the user input device 1408 can take a variety of forms, such as a button, keypad, dial, touch screen, audio input interface, visual/image capture input interface, input in the form of other sensor data, etc. Still further, the computing device 1400 can include a display 1410 (screen display) that can be controlled by the processor 1402 to display information to the user (for example, a movie or other AV or media content). A data bus 1416 can facilitate data transfer between at least a storage device 1440, the processor 1402, and a controller 1413. The controller 1413 can be used to interface with and control different equipment through and equipment control bus 1414. The computing device 1400 can also include a network/bus interface 1411 that couples to a data link 1412. In the case of a wireless connection, the network/bus interface 1411 can include a wireless transceiver.

The computing device 1400 can also include a storage device 1440, which can comprise a single disk or a plurality of disks (e.g., hard drives), and includes a storage management module that manages one or more partitions within the storage device 1440. In some embodiments, storage device 1440 can include flash memory, semiconductor (solid state) memory or the like. The computing device 1400 can also include a Random Access Memory (RAM) 1420 and a Read-Only Memory (ROM) 1422. The ROM 1422 can store programs, utilities or processes to be executed in a non-volatile manner. The RAM 1420 can provide volatile data storage, and stores instructions related to the operation of the computing device 1400.

The various aspects, embodiments, implementations or features of the described embodiments can be used separately or in any combination. Various aspects of the described embodiments can be implemented by software, hardware or a combination of hardware and software. The described embodiments can also be embodied as computer readable code on a computer readable medium. The computer readable medium is any data storage device that can store data which can thereafter be read by a computer system. Examples of the computer readable medium include read-only memory, random-access memory, CD-ROMs, DVDs, magnetic tape, hard disk drives, solid state drives, and optical data storage devices. The computer readable medium can also be distributed over network-coupled computer systems so that the computer readable code is stored and executed in a distributed fashion.

The foregoing description, for purposes of explanation, uses specific nomenclature to provide a thorough understanding of the described embodiments. However, it will be apparent to one skilled in the art that the specific details are not required in order to practice the described embodiments. Thus, the foregoing descriptions of specific embodiments are presented for purposes of illustration and description. They are not intended to be exhaustive or to limit the described embodiments to the precise forms disclosed. It will be apparent to one of ordinary skill in the art that many modifications and variations are possible in view of the above teachings.

What is claimed is:

1. An accessory device suitable for use with an electronic device that includes a display, the accessory device comprising:

a body having a size and shape to cover the electronic device, the body having a coupling surface; and a single magnet array carried by the coupling surface, the single magnetic array facilitating a single magnetic coupling between the body and the electronic device that allows the body to i) cover the display, and ii) fold away from the display and support the electronic device, wherein the single magnet array includes:

a first set of magnets that includes a first magnetic element and a second magnetic element, the first magnetic element having a magnetic polarity that matches that of the second magnetic element to define a symmetric magnetic polarity arrangement about a central point between the first magnetic element and the second magnetic element, and a second set of magnets surrounding the first set of magnets, the second set of magnets including a third magnetic element and a fourth magnetic element, the third magnetic element having a magnetic polarity that is different from that of the fourth magnetic element to define an asymmetric magnetic polarity arrangement about the central point.

2. The accessory device of claim 1, wherein the single magnet array corresponds to a pattern of alternating polarities for a mating magnet array of the electronic device, the single magnet array being configured to couple to the mating magnet array with 1) a normalized attraction force only at a predetermined orientation and alignment, and 2) and with less than half of the normalized attraction force at any other orientation and alignment.

3. The accessory device of claim 2, wherein the pattern of alternating polarities includes multiple magnetic sections that connect along a straight line.

4. The accessory device of claim 2, wherein the magnet array being coupled to the mating magnet array at a predetermined orientation and alignment results in the body being oriented and aligned with the electronic device.

5. The accessory device of claim 1, wherein the first magnetic element is symmetrically positioned from the second magnetic element such that the central point is equidistant from the first magnetic element and the second magnetic element, and wherein the third magnetic element is symmetrically positioned from the fourth magnetic element such that the central point is equidistant from the third magnetic element and the fourth magnetic element.

6. The accessory device of claim 1, further including:

electrical pins situated proximate the single magnet array and configured to align with and contact a corresponding plurality of electrical contacts on the electronic device.

7. The accessory device of claim 1, wherein one or more of the single magnet array includes a mating surface that is concave.

8. A magnetic coupling system between an electronic device and an accessory device, the coupling system comprising:

a first magnet array located in the accessory, device, wherein the first magnet array includes: i) a first set of magnets having a first magnetic element and a second magnetic element symmetrically aligned with the first magnetic element about a central point between the first magnetic element and the second magnetic element, the first magnetic element having a magnetic polarity that matches that of the second magnetic element to define a symmetric magnetic polarity arrangement, and ii) a second set of magnets surrounding the first set of magnets, the second set of magnets including a third magnetic element and a fourth magnetic element symmetrically aligned with the third magnetic element about the central point, the third magnetic element having a magnetic polarity that is different from that of the fourth magnetic element to define an asymmetric magnetic polarity arrangement about the central point; and a second magnet array located in the electronic device and adapted for a magnetic coupling the first magnet array, wherein the second magnet array includes a magnetic polarity arrangement corresponding to the first symmetric magnetic polarity arrangement and the asymmetric magnetic polarity arrangement.

9. The magnetic coupling system of claim 8, wherein the second magnet array couples to the first magnet array with a normalized attraction force only at an predetermined orientation and alignment and couples to the first magnet array with less than one-third of the normalized attraction force at any other orientation and alignment.

10. The magnetic coupling system of claim 8, wherein the magnetic coupling between the first magnet array and the second magnet array comprises a single magnetic coupling that allows for the accessory device to:

cover a display of the electronic device, and fold away from the display and support the electronic device.

11. The magnetic coupling system of claim 8, wherein the first magnet array defines a single magnet array in the accessory device.

12. The magnetic coupling system of claim 8, wherein the accessory device is configured to interact with the electronic device to facilitate an electrical function thereof.

13. The magnetic coupling system of claim 8, wherein the first set of magnets includes at least two magnetic elements surrounding the central point and having a magnetic polarity arrangement that is symmetric with respect to a corresponding magnetic element of the first set of magnets, and wherein the second set of magnets includes at least four magnetic elements surrounding the central point having a magnetic polarity arrangement that is asymmetric with respect to a corresponding magnetic element of the second set of magnets.

14. The magnetic coupling system of claim 8, wherein the first magnet array further includes a plurality of shunts disposed between adjacent magnets within the first magnet array, the plurality of shunts functioning to reduce an overall magnetic flux at a surface of the electronic device.

15. The magnetic coupling system of claim 8, wherein the first set of magnets have different lengths from each other.

16. The magnetic coupling system of claim 14, further including:

electrical contacts adapted for assembly with respect to the first magnet array at the surface of the electronic device; and pins adapted for assembly with respect to the second magnet array at the surface of the accessory device, wherein the pins align with and contacts the electrical contacts when the second magnet array couples to the first magnet array at a predetermined orientation and alignment.

17. The magnetic coupling system of claim 8, wherein one or more of the first magnet array and the second magnet array includes a mating surface that is concave.

18. A method for facilitating a magnetic alignment between an accessory device and an electronic device, the method comprising:

providing a first magnet array in the accessory device, the first magnet array including i) a first set of magnets having a first magnetic element and a second magnetic element symmetrically aligned with the first magnetic element about a central point between the first magnetic element and the second magnetic element, the first magnetic element having a magnetic polarity that matches that of the second magnetic element to define a symmetric magnetic polarity arrangement, and ii) a second set of magnets surrounding the first set of magnets, the second set of magnets including a third magnetic element and a fourth magnetic element symmetrically aligned with the third magnetic element about the central point, the third magnetic element having a magnetic polarity that is different from that of the fourth magnetic element to define an asymmetric magnetic polarity arrangement about the central point; and providing a second magnet array in the electronic device and including a magnetic polarity arrangement corresponding to the first symmetric magnetic polarity arrangement and the asymmetric magnetic polarity arrangement, wherein an automatic coupling between the second magnet array and the first magnet array with a normalized attraction force at a predetermined orientation and alignment occurs when the first magnet array is placed near the second magnet array at a general orientation and alignment, thereby causing the accessory device to be oriented and aligned with the electronic device.

19. The method of claim 18, further comprising:

providing electrical contacts proximate the first magnet array at a coupling surface of the electronic device; and providing pins proximate the second magnet array at a coupling surface of the accessory device, wherein the pins align with and contacts the electrical contacts to provide conduits for electrical connectivity between the accessory device and the electronic device as a result of the automatic coupling.

20. The method of claim 18, wherein providing the first magnet array comprises providing a single magnet array in the accessory device.

* * * * *